US006595164B2

(12) United States Patent
Kunze et al.

(10) Patent No.: US 6,595,164 B2
(45) Date of Patent: Jul. 22, 2003

(54) COOLING SYSTEM FOR AN INTERNAL COMBUSTION ENGINE COOLED WITH A LIQUID COOLANT

(75) Inventors: Jürgen Kunze, Rutesheim (DE); Peter Leu, Ostfildern (DE); Petra Röser, Fellbach (DE); Eike Willers, Stuttgart (DE)

(73) Assignee: Behr Thermot-Tronik GmbH, Kornwestheim (DE)

( * ) Notice: Subject to any disclaimer, the term of this patent is extended or adjusted under 35 U.S.C. 154(b) by 0 days.

(21) Appl. No.: 10/001,985

(22) Filed: Dec. 4, 2001

(65) Prior Publication Data

US 2002/0069839 A1 Jun. 13, 2002

(30) Foreign Application Priority Data

Dec. 11, 2000 (DE) ..... 100 61 546

(51) Int. Cl.[7] ..... F01P 7/14
(52) U.S. Cl. ..... 123/41.1; 123/41.29
(58) Field of Search ..... 123/41.1, 41.29

(56) References Cited

U.S. PATENT DOCUMENTS

| | | | | |
|---|---|---|---|---|
| 4,369,738 A | | 1/1983 | Hirayama | 123/41.1 |
| 4,370,950 A | | 2/1983 | Furukubo | 123/41.08 |
| 4,413,596 A | * | 11/1983 | Hirayama | 123/41.1 |
| 4,539,942 A | | 9/1985 | Kobayashi et al. | 123/41.1 |

FOREIGN PATENT DOCUMENTS

| | | |
|---|---|---|
| AT | 002 106 U1 | 4/1998 |
| DE | 33 17 454 A1 | 11/1984 |
| DE | 196 81 283 T1 | 10/1996 |
| GB | 421701 | 12/1934 |
| JP | 52-102941 | 8/1977 |
| JP | 57 135200 A | 8/1982 |
| JP | 60 019912 A | 1/1985 |
| JP | 61 167115 A | 7/1986 |
| JP | 06 101475 A | 4/1994 |
| JP | 06 212970 A | 8/1994 |
| JP | 09 329 010 A | 12/1997 |
| JP | 10 231727 A | 9/1998 |

* cited by examiner

*Primary Examiner*—Noah P. Kamen
(74) *Attorney, Agent, or Firm*—Kennedy Covington Lobdell & Hickman, L.L.P.

(57) ABSTRACT

An improved unified cooling system for an internal combustion engine that generally includes a cylinder head and a cylinder block, in which the cylinder head and cylinder block are maintained at different operating temperatures despite using only a single coolant pump. The coolant pump pumps fresh coolant through the cylinder head and cylinder block. Coolant valves, which may be thermostatic valves or electrically actuable proportional valves, lie downstream of the cylinder head and cylinder block and individually control the amount of coolant flowing through the cylinder head and cylinder block so as to maintain a lower operating temperature for the cylinder head than for the cylinder block. Coolant is directed, in various configurations, through any or all of an oil cooler, a heat exchanger for a heater for a vehicle interior, and a coolant radiator, before being directed back to the coolant pump.

16 Claims, 5 Drawing Sheets

COOLING SYSTEM FOR AN INTERNAL COMBUSTION ENGINE COOLED WITH A LIQUID COOLANT

CROSS-REFERENCES TO RELATED APPLICATIONS

This application claims the benefit of German patent application 10061546.5, filed Dec. 11, 2000, herein incorporated by reference.

1. Field of the Invention

The present invention relates to a cooling system for an internal combustion engine, such as for a motor vehicle, which is cooled by means of a liquid coolant. The cooling system of the present invention generally includes a coolant pump, a coolant radiator, coolant conduits in a cylinder head, coolant channels in a cylinder block, and a regulating device, which permits the cylinder head and the cylinder block to have different temperatures based upon regulation of the coolant flow.

2. Background of the Invention

Cooling systems of the type described above are known as dual-circuit cooling systems. One such cooling system is described in German patent no. DE 34 40 504 C2. The purpose of a dual-circuit cooling system is to permit the cylinder head and the intake ports to have a different temperature from that of the cylinder block. More than half of the frictional resistance of an internal combustion engine normally occurs in the cylinder block, and it is desirable to increase the efficiency of the engine by reducing frictional resistance. One means of reducing that frictional resistance is to increase the operating temperature of the cylinder block by controlling the coolant flow.

Typically, the cylinder head does not bear the same degree of frictional resistance as the cylinder block. Some beneficial reduction in friction in the cylinder head does occur with a higher operating temperature, specifically with a higher oil temperature, but there are other attendant problems with a higher temperature in the cylinder head and intake ports. For instance, the fill level of the cylinder (the degree to which air for the combustion process is introduced into the cylinder) drops when the cylinder head and intake ports are at a higher temperature. Because less oxygen is present for combustion purposes, the efficiency of the combustion reaction is reduced, wiping out any gains in efficiency that might have been had through reduction of frictional resistance in the cylinder head.

Consequently, it is desirable to achieve an operating condition of the engine such that the cylinder head has a temperature that is, overall, lower than a maximum safe operating temperature and, specifically, lower than that of the cylinder block. The usual solution to this design challenge is to provide a pair of coolant circuits, each of which is provided with its own coolant pump. The coolant circuits can be connected with each other in different ways by means of a valve control group. During warm-up, the two coolant circuits are switched in series, wherein the coolant radiator is bypassed by means of a short-circuit. Once the desired temperature of the cylinder head has been reached, the radiator is connected to the cylinder head coolant circuit, while the cylinder block coolant circuit remains short-circuited across the radiator. Then, when both coolant circuits are at their desired operating temperatures, a portion of the coolant from the cylinder head coolant circuit is admixed with coolant from the cylinder block coolant circuit, which has passed through the radiator. Additionally, temperature sensors are provided in the two coolant circuits in order to signal an electric drive motor of a blower for the coolant radiator to be switched on.

As can be seen from the above description, the design and operation of prior-art dual circuit cooling systems can be complex. Such complexity leads to increased design and manufacturing costs, as well as to an increased likelihood of failure in operation.

OBJECT AND SUMMARY OF THE INVENTION

It is accordingly an object of the present invention to improve upon, by simplification, prior art dual-circuit cooling systems as described above, and specifically to provide for a unified dual-temperature cooling system that includes a single coolant pump.

In order to meet this object, individual thermostatic valves are connected downstream of the cylinder head and the cylinder block, which valves operate to regulate the flow of coolant individually through the cylinder head and cylinder block based upon the temperature of the coolant flowing through the valves. For instance, when the coolant flowing through the cylinder head to one of the valves is below a predetermined temperature, the valve remains closed and no coolant (or only a trickle flow of coolant) is allowed to be drained from the cylinder head and replaced by cooler-temperature coolant. Likewise, coolant flowing through the cylinder block to the other valve is blocked until the coolant is at a separately determined temperature. In this manner, coolant flowing from a single coolant pump through the cylinder head or the cylinder block is individually regulated. By selecting the opening temperature for the cylinder head valve at a lower temperature than that at which the cylinder block valve is set, the effect of a dual-circuit cooling system is achieved more simply.

Moreover, the two thermostatic valves may have different flow cross-sections, so that when both valves are in their fully opened states, different amounts of coolant flow through one the individual valves and their corresponding engine members. In particular, a lower operating temperature for the cylinder head than for the cylinder block may be achieved, even when both valves are fully open, if the flow cross-section of the cylinder head valve is greater than that of the cylinder block valve. Consequently, more coolant flows through the cylinder head than flows through the cylinder block.

Further features and advantages of the invention are apparent from the claims and the following description of preferred embodiments of the invention in conjunction with the drawings.

DETAILED DESCRIPTION OF THE PREFERRED EMBODIMENTS

Figure 1:
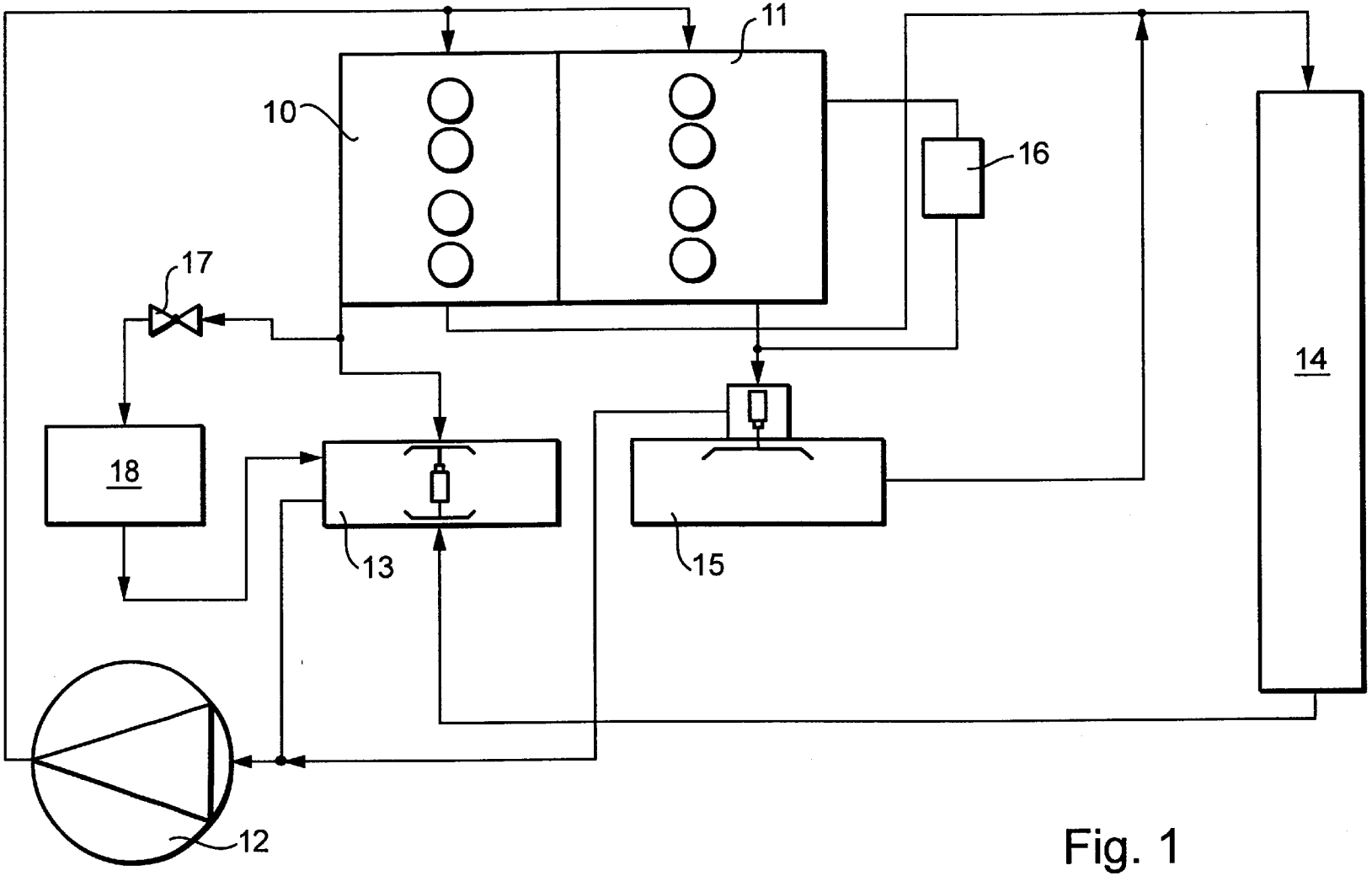
FIG. 1 is a schematic representation of a cooling system for an internal combustion engine according to the present invention, wherein the cylinder block and the cylinder head are set to different temperatures.

Referring now to FIG. 1, cylinder head 10 and cylinder block 11 are schematically depicted in a preferred embodiment of a cooling system according to the present invention. Coolant pump 12 conveys liquid coolant to cylinder head 10 and cylinder block 11, which enters both cylinder elements in parallel and flows through them longitudinally (i.e., in the direction of a row of cylinders) through coolant conduits. The coolant outlet of cylinder head 10 is connected directly to one inlet of thermostatic mixing valve 13 and indirectly to the other inlet of thermostatic mixing valve 13 via coolant radiator 14. The coolant outlet of thermostatic mixing valve 13 is connected to the input side of coolant pump 12.

Thermostatic opening valve 15 adjoins the outlet of the coolant channels of cylinder block 11 and is connected with the inlet of coolant radiator 14. As depicted in FIG. 1, a coolant line, or trickle line, branches off thermostatic opening valve 15 and connects to coolant pump 12. This line is designed to permit only a trickle or leak flow. Thermostatic opening valve 15 is designed to open at a temperature which is higher than the opening temperature of thermostatic mixing valve 13.

During starting or warm-up period of a cold internal combustion engine, coolant pump 12 conveys coolant through cylinder head 10 and thermostatic mixing valve 13 and back to coolant pump 12. Because only a trickle of coolant is permitted to flow through thermostatic opening valve 15, very little fresh coolant is being conveyed through cylinder block 11, and, consequently, cylinder block 11 heats up relatively rapidly. The trickle flow from thermostatic opening valve 15 is added to the coolant entering coolant pump 12. Moreover, because in this period coolant does not flow through coolant radiator 14, cylinder head 10 also heats up relatively rapidly until it reaches a temperature, lower than the temperature at which cylinder block 11 is designed to operate, at which thermostatic mixing valve 13 is designed to open.

When the thermostatic mixing valve 13 has reached its opening temperature, coolant flows along two flow paths associated with the cylinder head. A portion of the amount of coolant exiting cylinder head 10 flows through coolant radiator 14 and then to thermostatic mixing valve 13, while the remainder flows directly to thermostatic mixing valve 13. Only a trickle of coolant continues to flow through the cylinder block at this time. When thermostatic opening valve 15 has reached its opening temperature, coolant flows through cylinder block 11, after which it flows to coolant radiator 14 and from there to thermostatic mixing valve 13.

By this process, thermostatic mixing valve 13 sets the temperature of the coolant for the cylinder head to a predetermined level, which is less than the temperature for the cylinder block 11. The amount of coolant flowing through cylinder block 11 is determined by the position of thermostatic opening valve 15, which is designed to open at a higher temperature. During the course of operation, therefore, cylinder head 10 is set at a temperature which is lower than the temperature at which cylinder block 11 is set.

In addition to cooling the cylinder head and cylinder block, it is advantageous to use the coolant circuit to cool the engine oil. As can be further seen in FIG. 1, oil cooler 16 is connected in parallel with cylinder block 11. Accordingly, coolant flows through oil cooler 16 only when coolant also flows through cylinder block 11, and oil cooler 16 is set to a temperature which generally corresponds to the temperature of cylinder block 11.

A further use of the coolant circuit is to provide a means for drawing heat from the engine to heat the interior of a vehicle. FIG. 1 further depicts a coolant line with adjustable valve 17, which coolant line branches off the outlet of cylinder head 10 and leads to heat exchanger 18, which is part of the heating system for the vehicle interior. From heat exchanger 18, coolant is directed to the mixing chamber of thermostatic mixing valve 13.

In accordance with the present invention, thermostatic mixing valve 13 may be designed so that it completely closes the bypass connection between cylinder head 10 and coolant pump 12 until a predetermined opening temperature has been reached. To this end, the plate of thermostatic mixing valve 13 which services the bypass connection by controlling the flow of coolant therethrough is pushed into a blocking position by means of a spring. The effect of this arrangement is to permit thermostatic mixing valve 13 to act as a pressure control valve. A pressure control valve can also be separately provided at the housing of the mixing valve or at another location in the bypass. For example, it is possible for valve 17, properly provisioned, to serve as a pressure control valve in addition to its primary function of servicing heat exchanger 18. Pressure control valves are particularly desirable for this system during the starting/warm-up period because a cold engine is typically operated at an increased number of revolutions, which increases the amount of coolant flowing through the system. Because the system relies on thermostatic valves 13,15 placed downstream of cylinder head 10 and cylinder block 11, respectively, to control or, more to the point, block coolant flow therethrough, coolant pressure control, particularly in the warm-up period, is of some importance in aiding proper performance of the cooling system.

Figure 2:
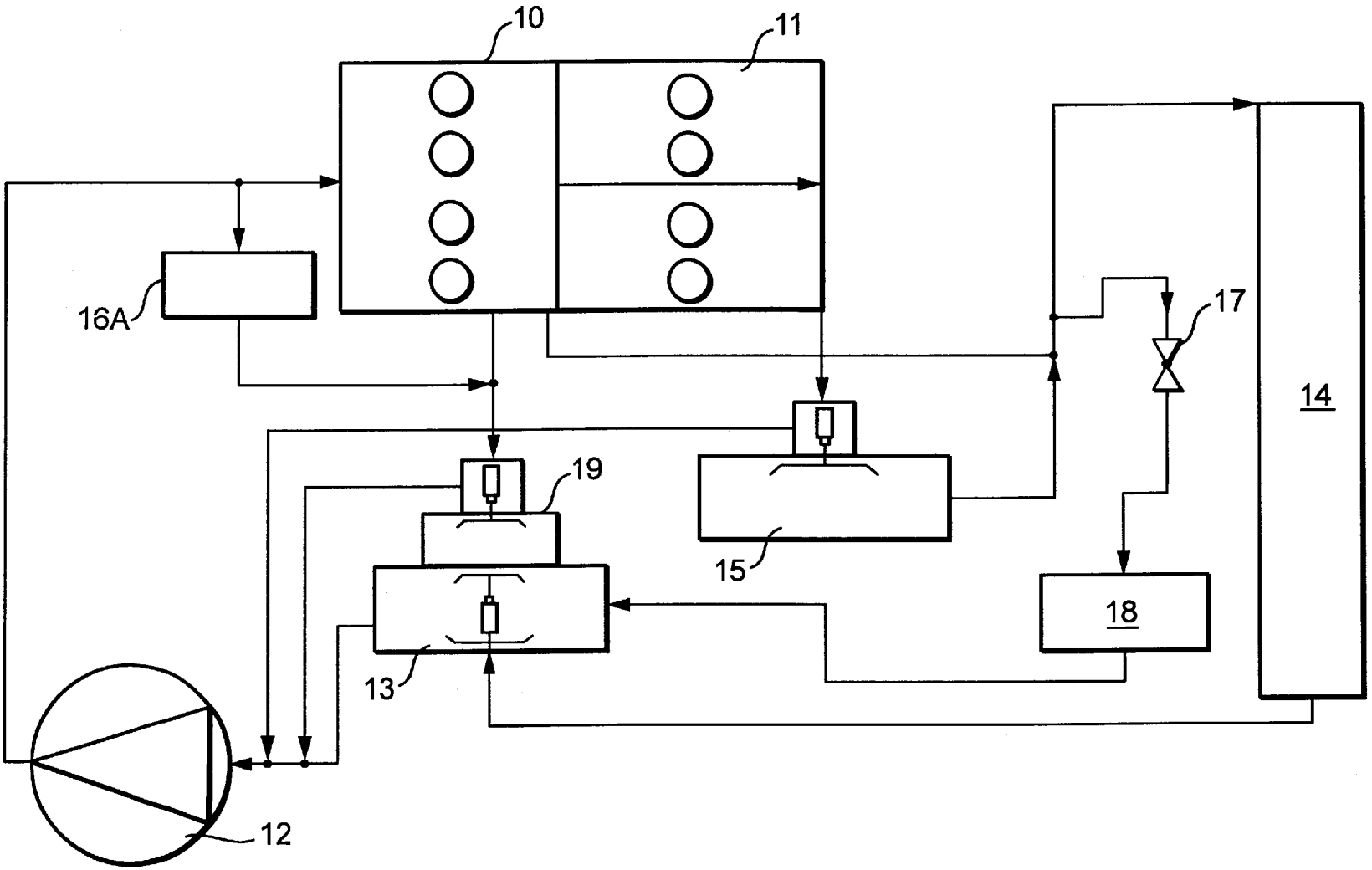
FIG. 2 is a schematic representation of a cooling system according to the present invention, further including a warm-up valve for the cylinder head.

Referring now to FIG. 2, a cooling system according to the present invention generally corresponds to that shown in FIG. 1, with several significant differences. For instance, thermostatic opening valve 19, which is designed to open at a temperature lower than the opening temperature of thermostatic mixing valve 13, is connected upstream of thermostatic mixing valve 13. Thermostatic opening valve 19 enables the bypass flow to be reduced during the warm-up period a trickle flow, which flows through the trickle line branching off from thermostatic opening valve 19 and leading to coolant pump 12. Thermostatic opening valve 19 is used as a warm-up valve and limits the amount of coolant flowing through cylinder head 11 during the warm-up period in order to decrease the time necessary for the system to reach its normal operating temperature.

The coolant line conducting coolant through regulating valve 17 and heat exchanger 18 branches off the outlet of the cylinder head 10 as in the embodiment according to FIG. 1 and leads to the mixing chamber of the thermostatic mixing valve 13. During normal operating conditions, coolant also flows from cylinder block 11 through thermostatic opening valve 15 to one of the flow paths conducting coolant from cylinder head 10, connecting upstream of the coolant line conducting coolant to heat exchanger 18. Consequently, a portion of the higher-temperature coolant from cylinder block 11 is conducted through heat exchanger 18.

In this embodiment oil cooler 16A is connected to the coolant circuit in parallel with the cylinder head.

Yet another difference between the embodiments in FIGS. 1 and 2 is that, in the embodiment according to FIG. 2, coolant flows successively through cylinder head 10 and cylinder block 11. Because of this sequential arrangement, the coolant that reaches cylinder block 11 has already been heated in cylinder head 10, thus favoring the intended temperature difference. As seen in FIG. 2, coolant flows transversely to the respective cylinder row through cylinder head 10 and cylinder block 11, as opposed to longitudinally as in FIG. 1.

Figure 3:
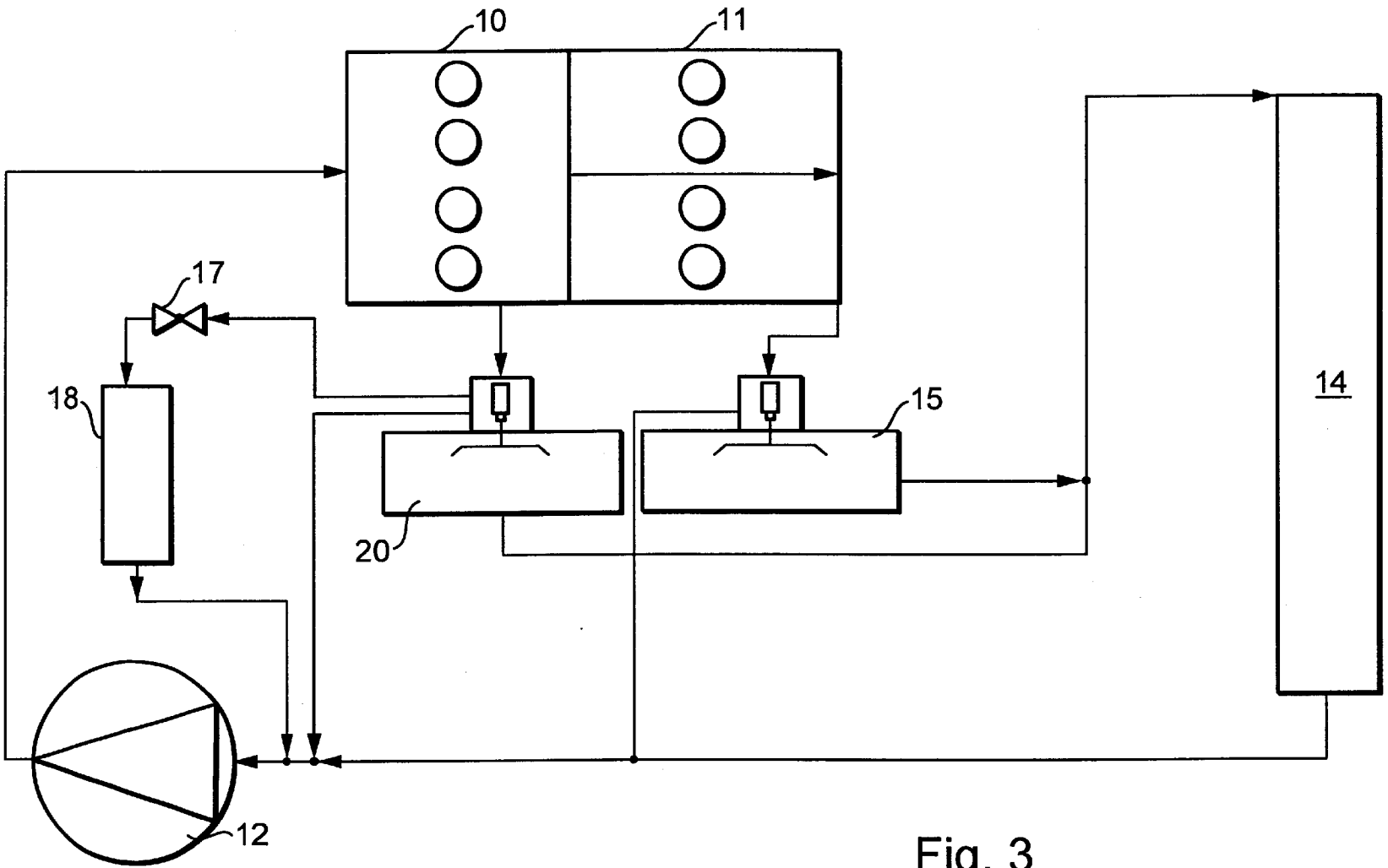
FIG. 3 is a schematic representation of a cooling system according to the present invention, wherein only simple thermostatic opening valves are connected downstream of the cylinder head and the cylinder block.

Referring now to FIG. 3, another embodiment of a cooling system according to the present invention is shown. As in the embodiment according to FIG. 2, in the embodiment depicted in FIG. 3, coolant flows sequentially through cylinder head 10 and the cylinder block 11, transversely to the cylinder row, although a sequential arrangement according to the present embodiment can of course be accomplished with a longitudinal flow.

The embodiment according to FIG. 3 essentially differs from that depicted in FIG. 1 in that thermostatic mixing valve 13 has been replaced by thermostatic opening valve 20. Thermostatic opening valve 20 is designed to open at a temperature which is lower than the opening temperature of thermostatic opening valve 15. The outlet of thermostatic opening valve 20 is connected to the inlet of coolant radiator 14. A line for a trickle flow, analogous to that provided for thermostatic opening valve 15, branches off the thermostatic opening valve 20 and leads to the coolant pump 12.

A coolant line directing coolant through regulating valve 17 and heat exchanger 18 branches off the inlet of thermostatic opening valve 20, or at least upstream of this inlet, and downstream of heat exchanger 18 connects directly to the inlet of the coolant pump 12.

In the present embodiment, it is also advantageous to provide thermostatic opening valve 20 or regulating valve 17 with a pressure control element, in order to account for the increased numbers of engine revolutions and the additional amount of flowing coolant possibly attendant to cold-starting.

Figure 4:
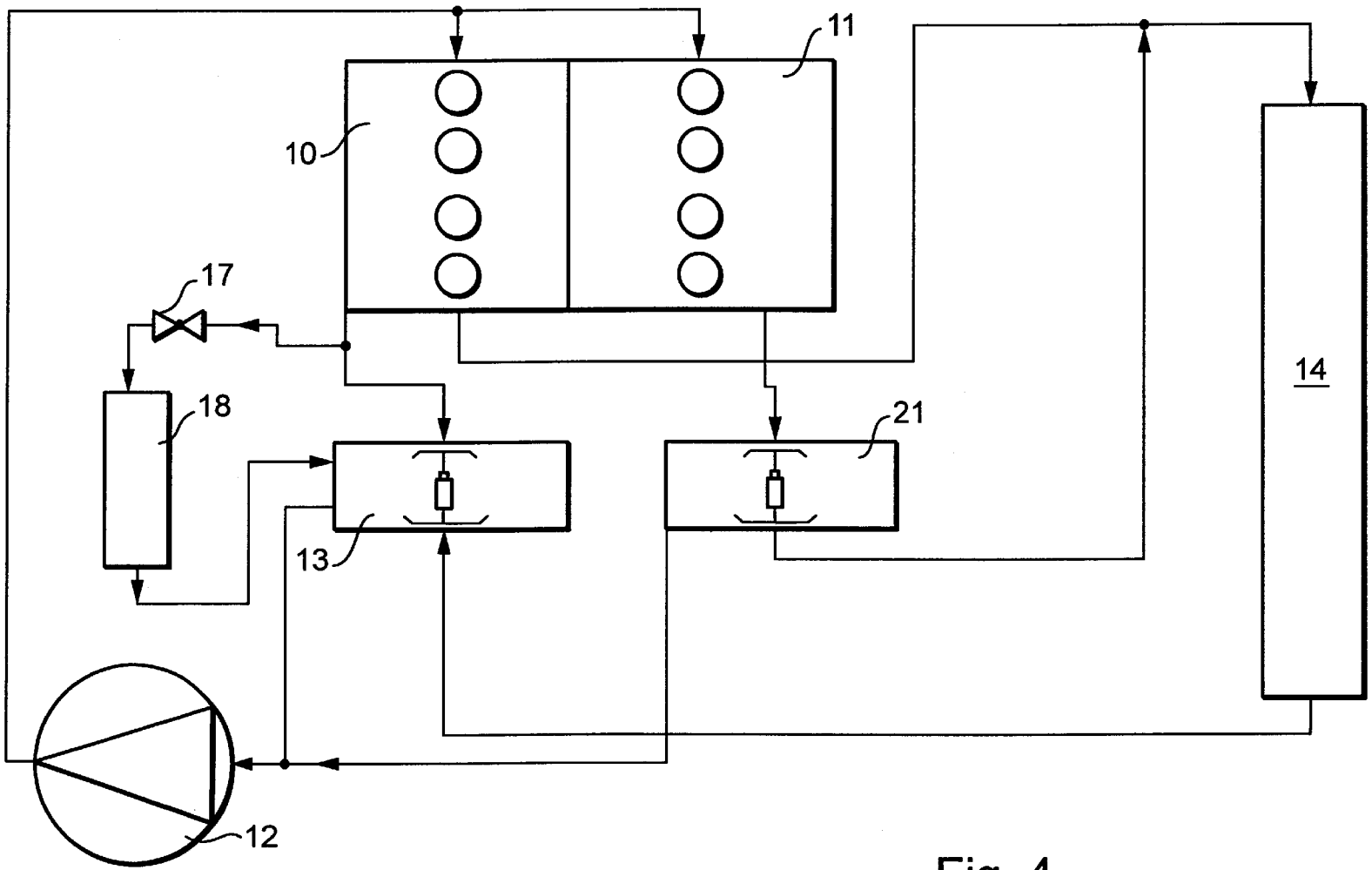
FIG. 4 is a schematic representation of a cooling system according to the present invention, wherein thermostatic mixing valves are connected downstream of the cylinder head and the cylinder block.

Referring now to FIG. 4, a cooling system in accordance with still another embodiment of the present invention is shown. The system shown in FIG. 4 is substantially the same as that depicted in FIG. 1, except that thermostatic opening valve 15 has been replaced with thermostatic double valve 21, which is connected downstream of cylinder block 11. Thermostatic double valve 21 performs roughly the opposite function of a thermostatic mixing valve by dividing the amount of coolant flowing from the cylinder block 11. A portion of the coolant entering thermostatic double valve 21 is conducted directly to coolant pump 12, and the remainder is conducted via coolant radiator 14 to thermostatic mixing valve 13 (which, as in previous embodiments, is connected downstream of cylinder head 10).

Figure 5:
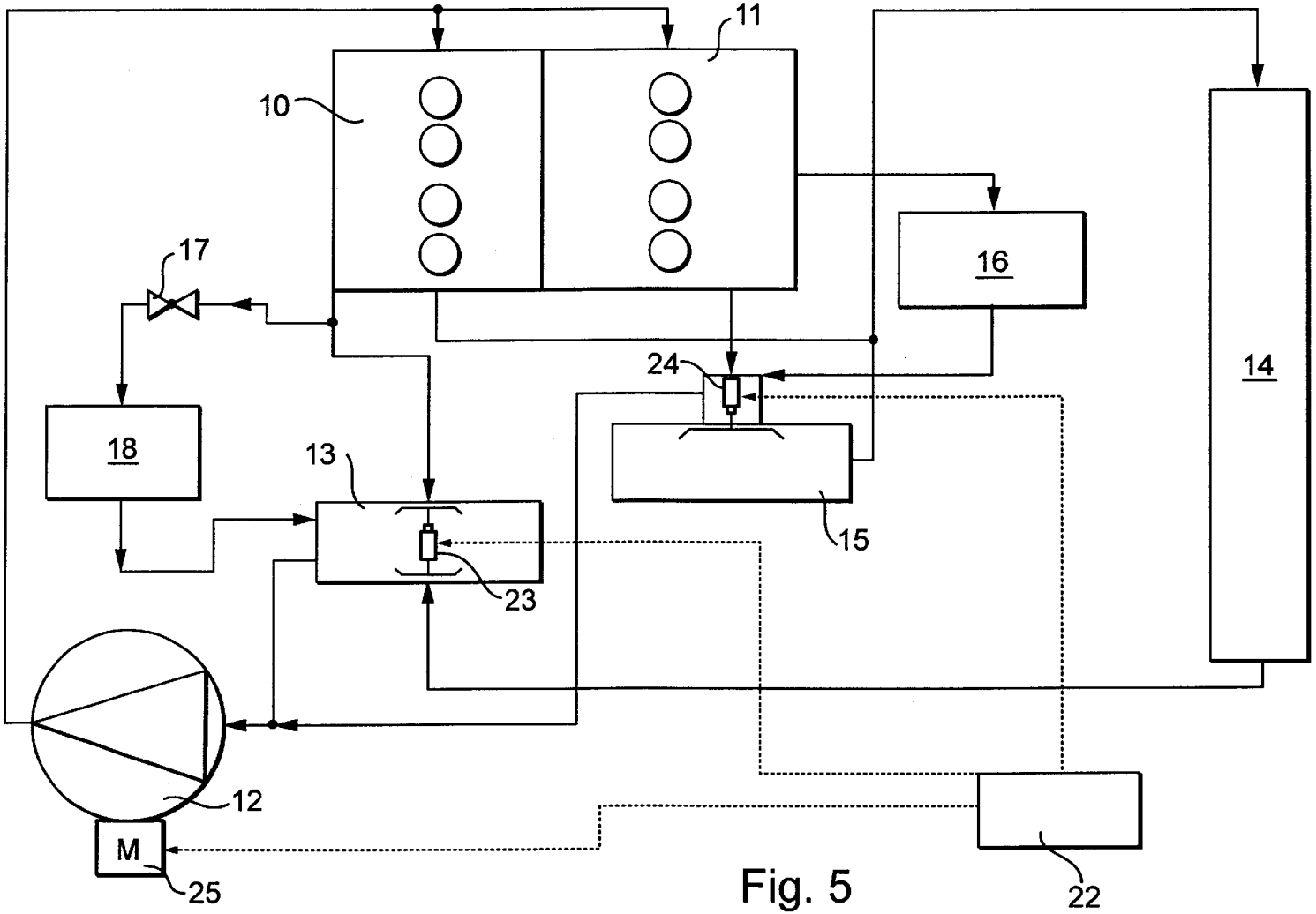
FIG. 5 is a schematic representation of a cooling system as in FIG. 1, wherein the thermostatic valves are equipped with an electrically heatable expansion element.

Referring now to FIG. 5, a cooling system as shown in FIG. 1 is shown with several additional features. First, in the embodiment according to FIG. 5, thermostatic mixing valve 13 and thermostatic opening valve 15 are provided with thermostatic operating elements 23 and 24, respectively. Thermostatic operating elements 23,24 are electrically operable actuators, which generally include a resistor heat exchanger, which can be controllably supplied with electrical energy from control device 22. This arrangement permits thermostatic mixing valve 13 to be designed to open at a high temperature, therefore permitting cylinder head 10 to operate at a high temperature. If, on the basis of operating or environmental parameters, control device 22 detects a demand from the cylinder head for an increased coolant flow, thermostatic operating element 23 can be controlled so that it actuates at a lower coolant temperature, opening thermostatic mixing valve 13 and cooling cylinder head 10.

Likewise, thermostatic opening valve 15 can be electrically controlled in order to open thermostatic opening valve 15 in accordance with detected operating or environmental parameters and to lower the temperature of cylinder block 11.

As is further shown in FIG. 5, coolant pump 12 can also be operated by means of an electric motor 25, the operating speed of which is controlled by control device 22. In accordance with this embodiment, the total coolant flow through the cooling system can be controlled systematically in order to optimize the temperature of the cylinder head 10 and the cylinder block 11.

In connection with embodiments as shown in FIGS. 1, 2 and 4, it is possible, for example, to set thermostatic mixing valve 13 to open at a coolant temperature of 95° C. If thermostatic opening valve 19 is connected upstream of the thermostatic mixing valve 13, as in FIG. 2., thermostatic opening valve 19 would be set to open at a lower coolant temperature, such as, for example, 80° C. Thermostatic opening valve 15—and, correspondingly, thermostatic valve 21—can be set to open at a coolant temperature of, for example, 105° C. Thus, a 15° C. differential in temperature between cylinder head 10 and cylinder block 11 can be maintained.

In connection with the embodiment as shown in FIG. 5, however, thermostatic mixing valve 13 is designed to open at a coolant temperature that corresponds to that of thermostatic opening valve 15, which is, for instance, 105° C. However, electrical current, applied by control device 22 to thermostatic operating element 23, acts to reduce the effective required coolant temperature for opening the valve to only 90° C. This embodiment, therefore, is able to accomplish the same function as the other embodiments but provides an additional degree of control over the precise details of operation.

In all of the embodiments, the coolant line that branches off to supply heat exchanger 18 branches from one of the flow paths from cylinder head 10. Those skilled in the art to which the present invention pertains will recognize that it is possible to draw coolant from the line serving cylinder block 11 for this purpose as well, and that some advantage might be obtained because of the higher operating temperature of cylinder block 11. However, in accordance with the present invention it is preferred to take it from one of the flow paths from cylinder head 10, if only because a larger amount of coolant flows therethrough. It is also possible in connection with all of the embodiments to replace any or all of the thermostatic valves with electrically actuable proportional valves.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A cooling system for an internal combustion engine including a cylinder head and a cylinder block, each cooled by means of a liquid coolant, the system comprising:

a coolant pump;

a coolant radiator;

coolant conduits in the cylinder head;

coolant channels in the cylinder block; and a regulating device for separately regulating a cylinder head temperature and a cylinder block temperature, wherein the regulating device comprises a first valve connected downstream of and regulating coolant flow through the cylinder head and a second valve connected downstream of and regulating coolant flow through the cylinder block;

wherein the first valve is a first thermostatic valve, the second valve is a second thermostatic valve, and the first thermostatic valve opens at a lower temperature than the second thermostatic valve; and wherein the first thermostatic valve is a thermostatic mixing valve, and wherein the liquid coolant flows from the cylinder head along one of a first flow path leading directly to the thermostatic mixing valve and a second flow path leading first to the coolant radiator and then to the thermostatic mixing valve.

2. The cooling system of claim 1, further comprising:

a third thermostatic valve connected downstream of the cylinder head and upstream of the first thermostatic valve, wherein the third thermostatic valve opens at a lower temperature than the first thermostatic valve; and a trickle line leading from the third thermostatic valve to the coolant pump.

3. The cooling system of claim 1, further comprising a first coolant line leading from the cylinder block through the second thermostatic valve to the coolant radiator.

4. The cooling system of claim 3, further comprising a second coolant line leading from the second thermostatic valve to the coolant pump.

5. The cooling system of claim 4, wherein the second coolant line is a trickle line.

6. The cooling system of claim 1, further comprising a coolant line leading from the cylinder head through a heat exchanger and to the first thermostatic valve.

7. The cooling system of claim 1, further comprising a coolant line leading from the cylinder head through a heat exchanger and to the coolant pump.

8. The cooling system of claim 1, further comprising a coolant line connected at one end thereof upstream of the cylinder block and at the opposite end thereof between the cylinder block and the second thermostatic valve, wherein the coolant line leads through an oil cooler.

9. The cooling system of claim 1, further comprising a coolant line connected at one end thereof upstream of the cylinder head and at the opposite end thereof between the cylinder head and the first thermostatic valve, wherein the coolant line leads through an oil cooler.

10. The cooling system of claim 1, wherein the first and second thermostatic valves are thermostatic opening valves, the system further comprising:

first and second trickle lines leading respectively from the first and second thermostatic valves to the coolant pump; and first and second coolant lines leading respectively from the first and second thermostatic valves to the coolant radiator.

11. The cooling system of claim 1, wherein at least one of the first and second thermostatic valves comprises an electrically heatable thermostatic operating element.

12. The cooling system of claim 11, further comprising a control device operable to control the thermostatic operating element by supplying an electrical current.

13. The cooling system of claim 12, wherein the control device controls the thermostatic operating element in accordance with one or more environmental parameters.

14. The cooling system of claim 12, wherein the control device controls the thermostatic operating element in accordance with one or more operating parameters.

15. The cooling system of claim 1, wherein at least one of the first and second valves is an electrically actuable proportional valve.

16. A method of cooling an internal combustion engine including a cylinder head and a cylinder block, the method comprising the steps of:

a) pumping liquid coolant with a coolant pump at a selected pressure through a coolant circuit having a plurality of flow paths, wherein at least one flow path extends through the cylinder head and at least one flow path extends through the cylinder block;

b) selecting a desired cylinder head temperature and a desired cylinder block temperature above the desired cylinder head temperature;

c) preventing the coolant from flowing away from the cylinder head, by closing a first valve connected downstream of the cylinder head, when the coolant in the cylinder head is below the desired cylinder head temperature;

d) permitting the coolant to flow away from the cylinder head, by opening the first valve, when the coolant in the cylinder head is above the desired cylinder head temperature;

e) preventing the coolant from flowing away from the cylinder block, by closing a second valve connected downstream of the cylinder block, when the coolant in the cylinder block is below the desired cylinder block temperature;

f) permitting the coolant to flow away from the cylinder block, by opening the second valve, when the coolant in the cylinder block is above the desired cylinder block temperature;

g) conducting coolant flowing away from the cylinder head and from the cylinder block to a coolant radiator; and h) conducting coolant from the coolant radiator to the coolant pump.

* * * * *